US011365047B1

(12) United States Patent
Mohns

(10) Patent No.: US 11,365,047 B1
(45) Date of Patent: Jun. 21, 2022

(54) SYSTEM PROVIDING EXTENDED ACCESSIBILITY FOR OPERATING A CLOSURE ASSEMBLY ON A STORAGE BIN

(71) Applicant: Brad Mohns, Jackson, MN (US)

(72) Inventor: Brad Mohns, Jackson, MN (US)

( * ) Notice: Subject to any disclaimer, the term of this patent is extended or adjusted under 35 U.S.C. 154(b) by 0 days.

(21) Appl. No.: 17/540,311

(22) Filed: Dec. 2, 2021

(51) Int. Cl.
*B65D 90/58* (2006.01)
*B65D 90/14* (2006.01)
*B65D 88/26* (2006.01)

(52) U.S. Cl.
CPC ..... *B65D 90/587* (2013.01); *B65D 88/26* (2013.01); *B65D 90/14* (2013.01)

(58) Field of Classification Search
CPC .... B65D 90/58; B65D 90/587; B65D 90/585; B65D 90/54; B65D 90/582; B65D 90/14; B65D 90/66; B65D 88/54; B65D 88/26; B65D 47/20; B65D 47/26; B65D 47/28; B65D 47/286; B65D 47/283
See application file for complete search history.

(56) References Cited

U.S. PATENT DOCUMENTS

| | | | | |
|---|---|---|---|---|
| 1,630,605 | A * | 5/1927 | Butler | B65D 88/26 222/129 |
| 7,762,281 | B2 * | 7/2010 | Schuld | B65D 88/26 222/428 |
| 8,851,453 | B2 * | 10/2014 | de Zwart | B65D 90/66 280/433 |
| 10,543,496 | B2 * | 1/2020 | Vogt | B05B 7/1404 |
| 2003/0159658 | A1 * | 8/2003 | Adams | A01K 5/02 119/53 |

* cited by examiner

*Primary Examiner* — Mark C Hageman
(74) *Attorney, Agent, or Firm* — Jeffrey A Proehl; Woods, Fuller, Shultz & Smith, PC

(57) ABSTRACT

A system may include a closure actuation assembly to actuate a bin closure apparatus on a storage bin apparatus, and the assembly may include a gate movement structure to move a gate of the closure assembly. The gate movement structure may include a movement rod for engaging the gate. The actuation assembly may further include a support structure which in turn includes a support beam for mounting on the bin elevating structure, a securing element provided on the support beam for securing the support beam, and a support plate mounted on the support beam and having an adjustment slot for passing the movement rod therethrough. The support structure may include a support slide mounted on the support plate and having a support aperture to receive the movement rod passing through the adjustment slot. The position of the support slide over the adjustment slot may be adjustable.

14 Claims, 6 Drawing Sheets

SYSTEM PROVIDING EXTENDED ACCESSIBILITY FOR OPERATING A CLOSURE ASSEMBLY ON A STORAGE BIN

BACKGROUND

Field

The present disclosure relates to storage bins and more particularly pertains to a new system providing extended accessibility for operating a closure assembly on a storage bin for increasing the accessibility of the closure assembly for operation.

SUMMARY

In one aspect, the present disclosure relates to a system which may comprise a closure actuation assembly configured to actuate a bin closure apparatus on a storage bin apparatus. The bin closure apparatus may include a closure assembly movable between a closed condition and an open condition. The closure actuation assembly may comprise a gate movement structure configured to move a gate of the closure assembly such that movement of the gate movement structure causes movement of the gate. The gate movement structure may include a movement rod for being engaged with the gate of the closure assembly, and the rod may have a first extent for extending from the gate. The closure actuation assembly may further include a support structure for supporting the gate movement structure on a bin elevating structure of the storage bin apparatus. The support structure may comprise a support beam for mounting on the bin elevating structure, and the support beam may be elongated with a pair of opposite end portions. The support structure may further include a securing element provided on the support beam for securing a portion of the support beam to the bin elevating structure, and a support plate mounted on the support beam such that the support beam supports the support plate when the support beam is mounted on the bin elevating structure and the support plate depends from the support beam. The support plate may extend along a portion of the length of the support beam between the pair of opposite end portions. The support plate may have an upper boundary and a lower boundary opposite of the upper boundary, and the upper boundary may be united to the support beam. An adjustment slot may be formed in the support plate for passing a portion of the movement rod therethrough, and the adjustment slot may extend into the support plate from the lower boundary toward the upper boundary. The support structure may further include a support slide mounted on the support plate, and a support aperture may be formed in the support slide for receiving a portion of the movement rod passing through the support aperture. The support slide may be mounted over a portion of the adjustment slot, and a position of the support slide over the adjustment slot may be adjustable to adjust a position of the support aperture on the support plate.

In another aspect, the present disclosure relates to a system which may comprise a bin closure apparatus for selectively closing a bottom opening of a bin structure of a storage bin apparatus, and the bin closure apparatus may include a closure assembly configured to selectively close the bottom opening of the bin structure. The closure assembly may have a closed condition and an open condition. The closed condition may be characterized by the closure assembly being positionable to block movement of contents of an interior of the bin structure from moving out of the bottom opening, while the open condition may be characterized by the closure assembly not being positionable to block movement of the contents of the interior of the bin structure out of the bottom opening. The closure assembly may comprise a guide frame for mounting on the bin structure adjacent to the bottom opening of the bin structure, and the guide frame may form a movement track. The closure assembly may further comprise a gate mounted on the guide frame and be moveable on the movement track between a closed position on the movement track corresponding to the closed condition of the closure assembly and an open position on the movement track corresponding to the open condition of the closure assembly. The system may also comprise a closure actuation assembly configured to actuate the closure assembly, and the closure actuation assembly may comprise a gate movement structure for moving the gate of the closure assembly, which may include a movement rod connected to the gate of the closure assembly. The closure actuation assembly may further comprise a support structure for supporting the gate movement structure on a bin elevating structure of the storage bin apparatus. The support structure may comprise a support beam for mounting on the bin elevating structure, and the support beam being elongated with a pair of opposite end portions. The support structure may further comprise a securing element provided on the support beam for securing a portion of the support beam to the bin elevating structure, and a support plate mounted on the support beam such that the support beam supports the support plate when the support beam is mounted on the bin elevating structure and the support plate depends from the support beam. The support plate may extend along a portion of the length of the support beam between the pair of opposite end portions. The support plate may have an upper boundary and a lower boundary opposite of the upper boundary, and the upper boundary may be united to the support beam. An adjustment slot may be formed in the support plate and extend into the support plate from the lower boundary toward the upper boundary. A portion of the movement rod may extend through the adjustment slot. The support structure may also comprise a support slide mounted on the support plate, and a support aperture may be formed in the support slide. The support slide may be mounted over a portion of the adjustment slot to receive the portion of the movement rod passing through the adjustment slot. A position of the support slide over the adjustment slot may be adjustable to adjust a position of the support aperture on the support plate and thereby adjust a position of the portion of the movement rod passing through the adjustment slot.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
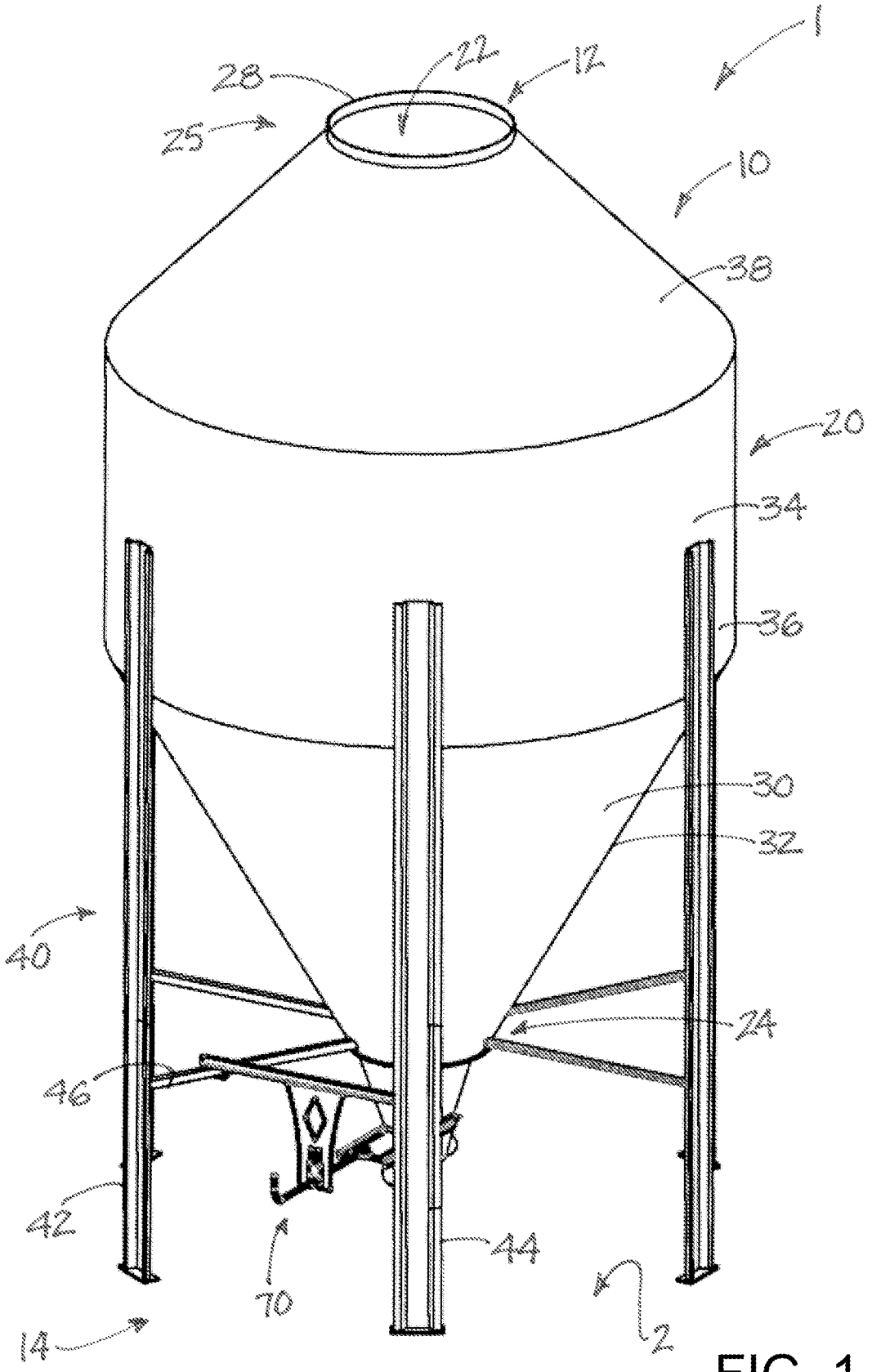
FIG. 1 is a schematic perspective view of a new system providing extended accessibility for operating a closure assembly on a storage bin according to the present disclosure.
Figure 2:
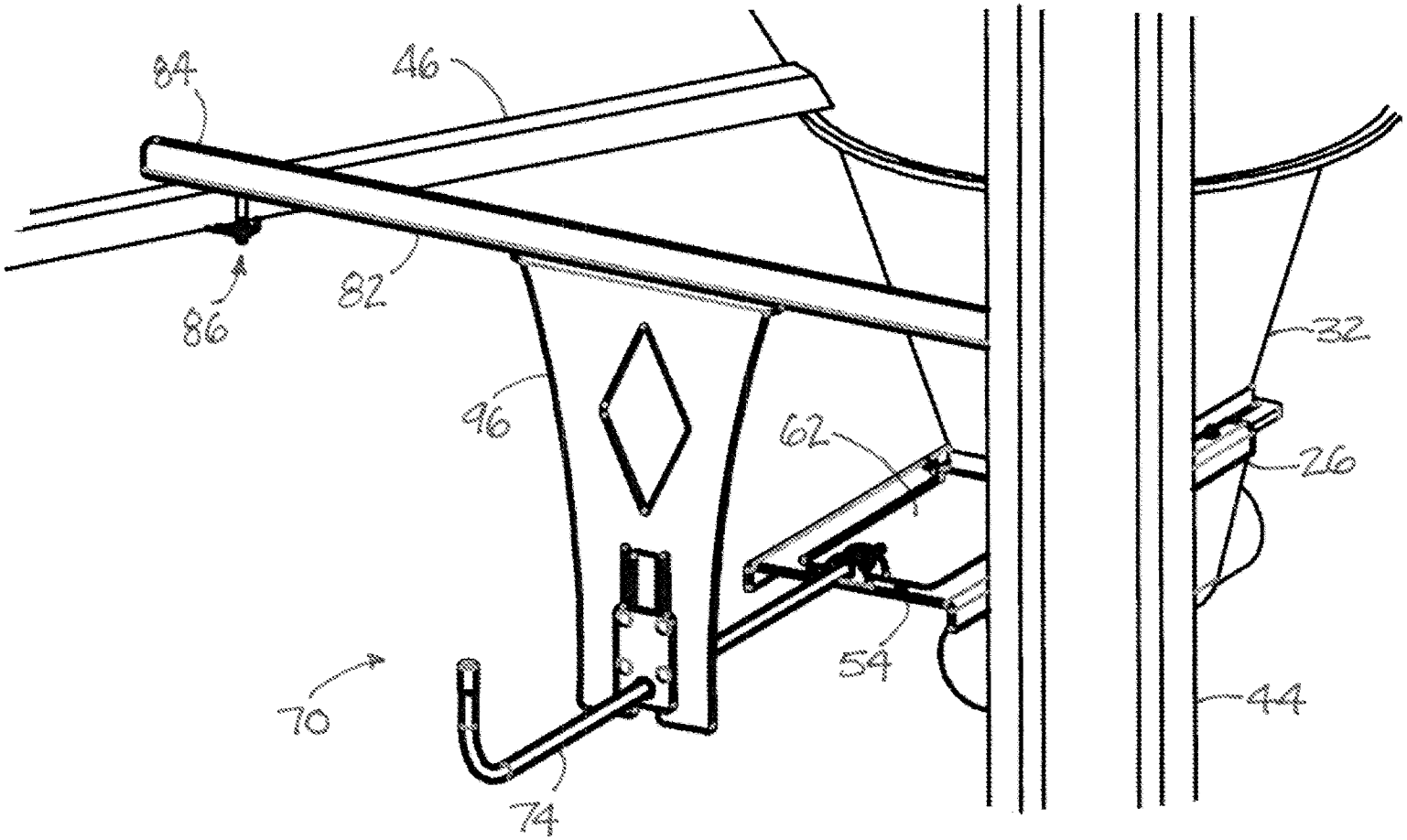
FIG. 2 is a schematic perspective view of an enlarged portion of the system shown in FIG. 1, according to an illustrative embodiment.
Figure 3:
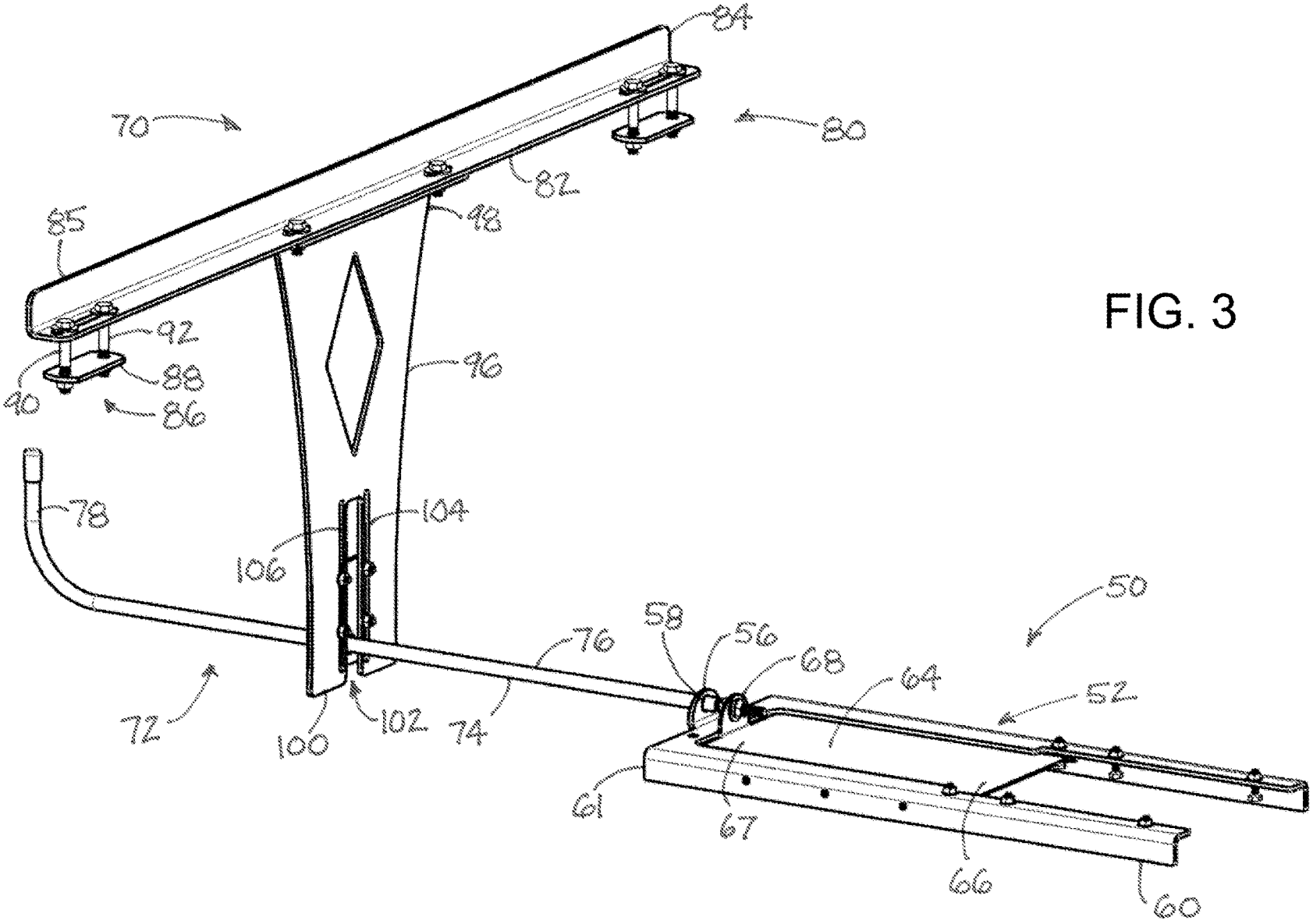
FIG. 3 is a schematic perspective view of the closure assembly and closure actuation assembly isolated from other elements of the system, according to an illustrative embodiment.
Figure 4:
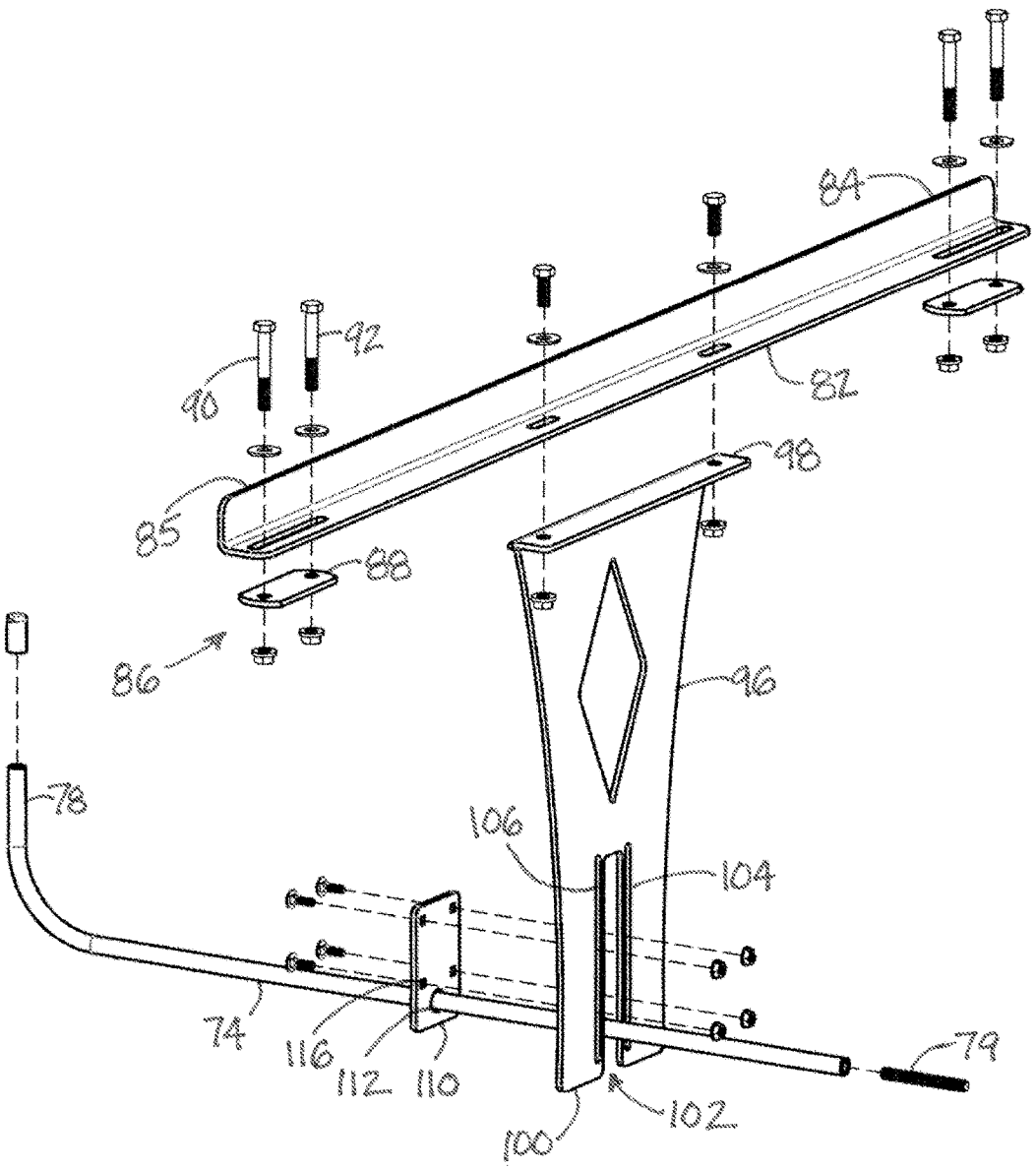
FIG. 4 is a schematic exploded perspective view of the closure actuation assembly isolated from other elements of the system, according to an illustrative embodiment.
Figure 5:
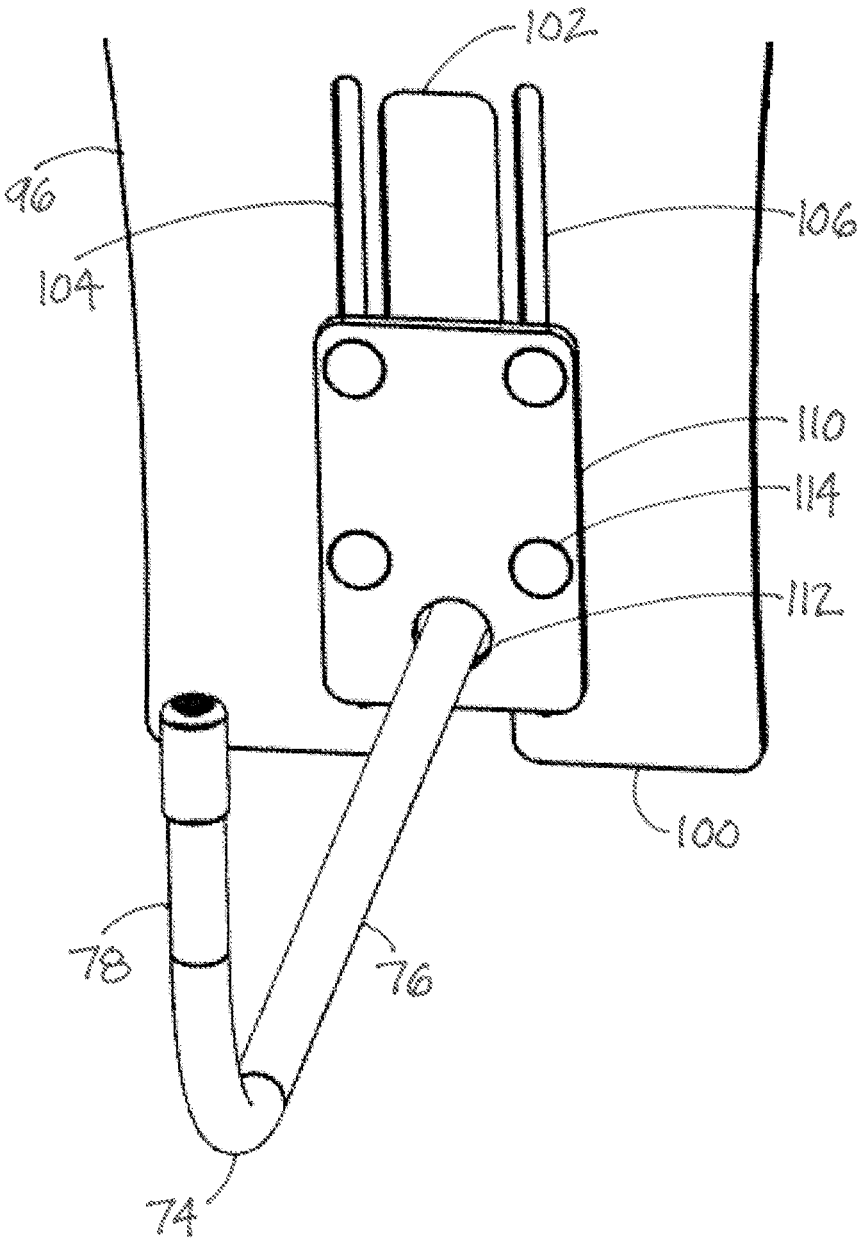
FIG. 5 is a schematic perspective view of a portion of the closure actuation assembly, according to an illustrative embodiment.
Figure 6:
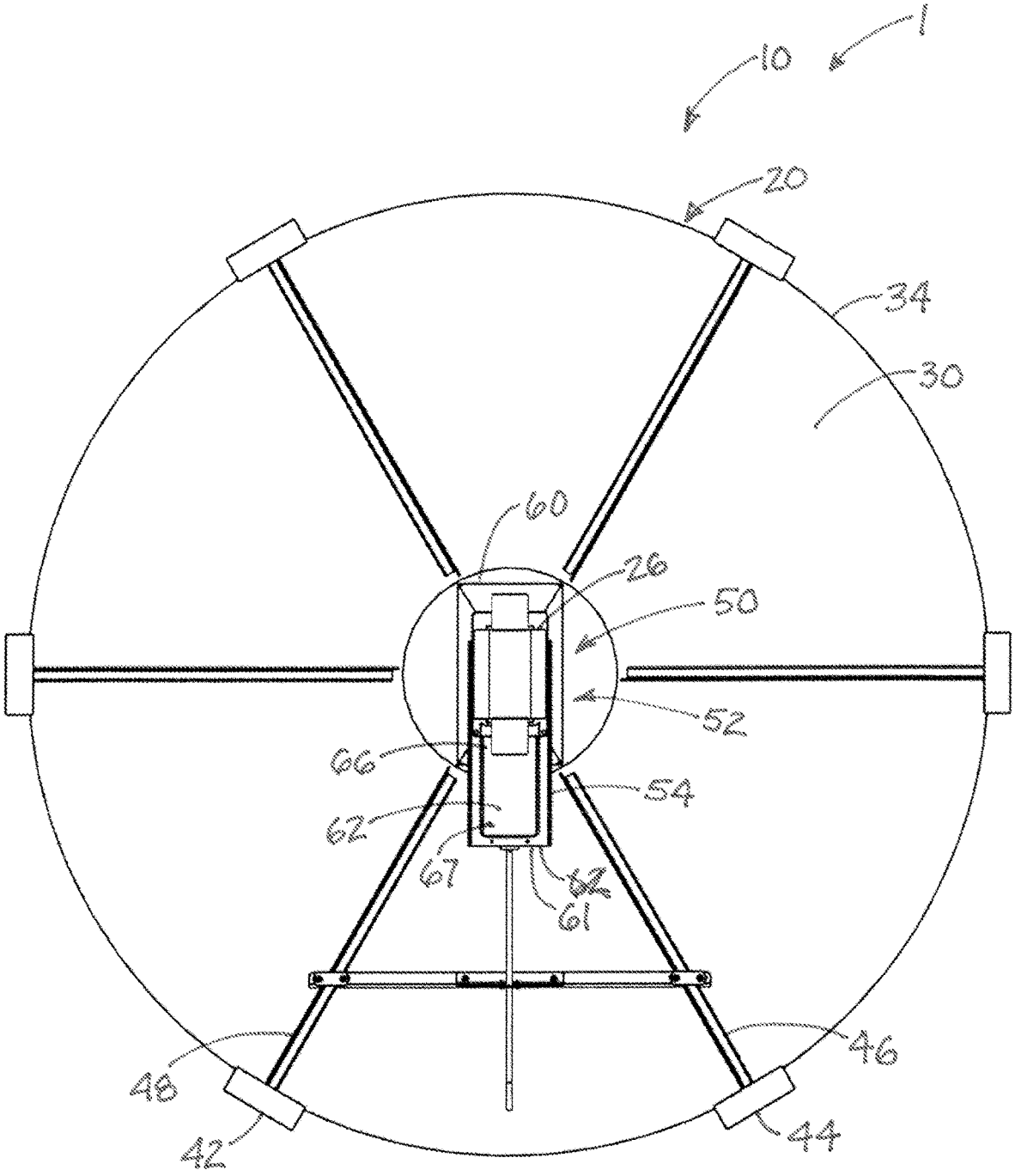
FIG. 6 is a schematic bottom view of the system, according to an illustrative embodiment.

With reference now to the drawings, and in particular to FIGS. 1 through 6 thereof, a new system providing extended accessibility for operating a closure assembly on a storage bin embodying the principles and concepts of the disclosed subject matter will be described.

The applicants have recognized that hopper-style bulk storage bins are highly popular for storage of particulate or granular material used for feed or other purposes. Such storage bins are typically elevated off of the ground, and have hopper-like lower portions which taper smaller in size to guide the contents toward a bottom opening of the bin. While facilitating the complete emptying of the bin contents, the tapering of the lower portion typically positions the bottom opening at a central location beneath the bin and away from the outermost peripheral side extent of the bin.

Because the diameter of the bin can measure up to 9 feet or possibly more, the bottom opening, as well as the closure assembly utilized to selectively open and close the bottom opening, can be positioned a significant distance inward from the outermost peripheral side extent of the bin. This characteristic often requires an operator to crouch or crawl partially under the lower portion of the bin in order to manually operate the closure assembly. Such maneuvering by the operator can be difficult because of the presence of supporting legs and supporting braces beneath the lower portion of the bin wall, all of which may present the hazard of accidental contact with the head or torso of the operator. The difficulty of reaching the closure assembly may vary based upon the diameter size of the bin and the style (or manufacturer) of the bin, among other factors, all of which may affect the number of legs supporting the bin wall as well as the configuration of any bracing extending between the legs and the bin wall of the lower portion of the bin.

The applicants have also recognized that it would be highly beneficial to develop a closure actuation assembly for operating the closure assembly from a location only peripherally under the bin wall, as this would reduce or eliminate the need for the operator to crouch his or her body underneath the bin when operating the closure actuation assembly, while avoiding the addition of structure that protrudes beyond the "footprint" of the bin so as not to introduce a hazard for tripping or catching on things or people passing by the bin. The applicants have also recognized that the closure actuation assembly would benefit from being as universally adaptable to different bin leg and brace configurations encountered in different size bins and bins from different sources or manufacturers to minimize the need for different, specialized configurations for the actuation assembly.

In one aspect, the disclosure relates to a system 1 which may be utilized for storing and dispensing particulate material, such as feed for livestock animals. Other applications of the system 1 may become apparent to those skilled in the art with knowledge of the present disclosure. In general, the system 1 may include a storage bin apparatus 10 for storing particulate material and a bin closure apparatus 50 for selectively closing an opening on the storage bin apparatus, although various embodiments of the system may include, for example, the bin closure apparatus 50, or sub portions of the bin closure apparatus, without other elements of the system.

The storage bin apparatus 10 of the system 1 may be a freestanding unit having an uppermost extent 12 and a lowermost extent 14, with the lowermost extent generally being configured for resting on a ground surface 2. The storage bin apparatus 10 may generally include a bin structure 20 for receiving and holding particulate material and a bin elevating structure 40 for elevating the bin structure above the ground surface. In greater detail, the bin structure 20 may define an interior 22 which receives that holds the material to be stored, and may generally have a bottom 24 that is positioned toward the lowermost extent 14 of the apparatus 10 and a top 25 that is positioned toward the uppermost extent 12 of the apparatus. The bin structure 20 has a bottom opening 26 oriented toward the bottom of the bin structure and is in communication with the interior 22 of the bin structure such that the contents of the bin structure may move out of the interior through the bottom opening. Illustratively, the bottom opening 28 may be substantially rectangular in shape, although other configurations, such as round or circular, may also be utilized. The bin structure 20 may have a top opening 28 toward the top of the bin structure which is in communication with the interior 22 of the bin structure to permit filling of the interior of the bin structure through the top opening.

The bin structure 20 may include a bin floor 30 which is located toward the bottom 24 of the bin structure and the bottom opening 26 may be formed in the bin floor. In some embodiments, the bin floor 30 may taper narrower in width toward the bottom 26 of the bin structure and the bottom opening 26 to help guide the contents toward the opening 26, and may taper wider toward the top 25 of the bin structure.

Illustratively, the bin floor 30 may have an inverted frustoconical shape. The bin floor 30 may have a bin floor exterior surface 32.

The bin structure 20 may also include a perimeter wall 34 which may extend about the interior 22 of the bin structure and may extend upwardly from the bin floor 30. The perimeter wall 34 may illustratively be substantially cylindrical in shape, and has a perimeter wall exterior surface 36. The bin structure 20 may further include a roof 38 located toward the top 25 of the bin structure which may extend upwardly from the perimeter wall 34. The top opening 28 may be formed in the roof 38. The roof 38 may taper narrower in width toward the top of the bin structure and may taper wider in width toward the perimeter wall 34. Illustratively, the roof 38 may have a frustoconical shape.

The bin elevating structure 40 may support the bin structure 20 at an elevation above the ground surface 2 such that the bottom opening 26 is elevated or raised above the surface 2 to facilitate the removal or dispensing of the contents of the interior 22 from the bin structure. The bin elevating structure 40 may include a plurality of legs 42 which extend downwardly from the bin structure 20 to rest upon the surface below the bin apparatus 10, such as the ground or a floor of a building. Each of the legs 42 may be substantially vertically oriented, and may be oriented substantially parallel to each other. In some embodiments, the plurality of legs 42 may be mounted on the perimeter wall 34 of the bin structure, and may be substantially uniformly spaced about the circumference of the perimeter wall. In the illustrative embodiments, the plurality of legs comprises six leg, although more or fewer legs may be utilized.

The elevating structure 40 may further include at least one cross brace 46 which extends between one of the legs 42 and a portion of the bin structure 20. The cross brace 46 is typically elongated with one end being mounted on the one leg and an other end being mounted on the bin structure to fix the position of the leg with respect to the bin structure. The cross brace 46 may be substantially horizontally oriented. In embodiments, a plurality of cross braces 46, 48 are provided with each cross brace linking one of the legs to the bin structure. The cross braces 46, 48 may be positioned in a substantially horizontally oriented common plane, and may be oriented at an angle with respect to each other. Illustratively, the angle may be from approximately 30 degrees to approximately 90 degrees.

The bin closure apparatus 50 of the system 1 may provide the a capability of selectively closing or blocking the bottom opening 26 of the bin structure to retain the contents in the interior 22 of the bin structure, as well as opening or unblocking the bottom opening to permit dispensing of the contents from the interior of the bin structure.

The bin closure apparatus 50 may generally include a closure assembly 52 configured to selectively close the bottom opening of the bin structure. The closure assembly 52 may have a closed condition which may be characterized by the closure assembly blocking movement of the contents of the interior of the bin structure out of the bottom opening, and an open condition which may be characterized by the closure assembly not blocking movement of the contents of the interior of the bin structure through the bottom opening. The closure assembly 52 may include a guide frame 54 which may be mounted on the bin structure at a location adjacent to the bottom opening 26 of the bin structure. The guide frame 54 may have a guide tab 56 with a guide aperture 58 formed therein. The guide frame 54 may be elongated in shape and have a first end 60 which is positioned adjacent to the bottom opening 26 of the bin structure and a second end 61 which is positioned away from the bottom opening relative to the first end 60. The guide tab 56 may be located at the second end of the guide frame. The guide frame 54 may form a movement track for the gate 62.

The closure assembly 52 may also include a gate 62 mounted on the guide frame 54 such that the frame 54 forms a movement track along which the gate is movable. The gate 62 may have a closed position on the movement track which corresponds to the closed condition of the closure assembly and an open position on the movement track which corresponds to the open condition of the closure assembly. The gate 62 may be positioned toward the first end 60 of the frame 54 in the open position and may be positioned toward the second end 61 of the frame 54 in the open position. The gate 62 may have a first surface 64 that is positionable adjacent to the bottom opening 26 of the bin structure and upwardly oriented to close or block the opening 24. The gate 62 may be elongated with a first end 66 which is generally oriented toward the first end 60 of the guide frame and a second end 67 which is oriented toward the second end 61 of the guide frame. A gate tab 68 may be formed on the gate, and may be located toward or at the first end 66.

The bin closure apparatus 50 may further include a closure actuation assembly 70 which is configured to actuate or operate the closure assembly 52 between the closed condition and the open condition. The closure actuation assembly 70 may include a gate movement structure 72 for moving the closure assembly between the closed condition and the open condition. The gate movement structure 72 may be engaged with the gate 62 in a manner such that movement of the gate movement assembly causes movement of the gate.

In the illustrative embodiments, the gate movement structure 72 includes a movement rod 74 that engages the gate 62 of the closure assembly. The movement rod 74 may be connected to the gate 62 in a manner that permits movement of the rod 74 to be transferred to the gate 62. Illustratively, the movement rod 74 may be connected to the gate tab 68 so that the rod 74 in the gate (via the tab 68) may move as a unit. A portion of the movement rod 74 may extend though the guide aperture 58 in the guide tab 56 of the frame 54. In some embodiments, the rod 74 may have a first extent 76 extending from the gate 62, and which may be in a substantially horizontal orientation and move in a substantially horizontal plane. The movement rod 74 may also have a second extent 78 extending from the first extent 76, and may be oriented substantially perpendicular to the first extent such that the second extent is substantially vertically oriented, and may extend upwardly from the first extent 76. The length of the movement rod 74, and in particular the length of the first extent 76 of the rod, may be selected to reflect the particular diameter size of the perimeter wall of the bin structure 34.

Optionally, the gate movement structure 72 may include a rod extension 79 which is mounted on the movement rod 74, and may be mounted on the rod to extend from the first extent 76 of the rod. The rod extension 79 may have threads formed thereon, and the extension may be threaded into a threaded cavity extending into the end of the first extent 76 of the movement rod such that the degree of extension of the rod extension from the movement rod is adjustable. At least one threaded nut may be mounted on the rod extension 79 in order to secure the position of the rod extension on the gate tab 68 of the gate, and thereby secure the gate 62 to the movement rod 74.

The closure actuation assembly 70 may further include a support structure 80 for supporting the gate movement structure 72. In the illustrative embodiments, the support structure 80 is mounted on the bin elevating structure 40, although other mounting points for the structure 80 may be utilized.

The support structure 80 may include a support beam 82 which may be mounted on the bin elevating structure 40, such as on at least one of the cross braces 46 of the structure 40. Optionally, the support beam 82 may be mounted on one or more of the legs 42, 44 of the structure 40. Illustratively, the support beam 82 may be mounted on two of the cross braces 46, 48 of the elevating structure 40, and in some implementations the beam 82 may bridge between the braces 46, 48 and have a substantially horizontal orientation. The support beam 82 has a pair of opposite end portions 84, 85, and each of the end portions may each be secured to one of the cross braces 46, 44.

In some embodiments, the support structure 80 includes a securing element 86 provided on the support beam 82 for securing the beam 82 to the elevating structure 40, such as at least one of the cross braces. Illustratively, a pair of the securing elements may be provided to secure each one of the end portions 84, 85 of the support beam to one of the cross braces 46, 48. In the illustrative embodiments, each of the securing elements may include a securing plate 88 and a pair of securing fasteners 90, 92. The pair of securing fasteners 90, 92 may fasten the securing plate 88 to the support beam, and the securing fasteners 90, 92 may be spaced with respect to each other and the respective cross brace may be positioned between the securing fasteners. The fasteners 90, 92 may be tightened to draw the plate 88 closer to the beam 82 to clamp the brace between the plate and beam.

The support structure 80 may further include a support plate 96 mounted on the support beam 82 such that the support beam 82 supports the support plate on the bin elevating structure 40. The support plate 96 may depend or extend down from the support beam 82, such as in a substantially vertical plane, and may extend along a portion of the length of the beam 82. The support plate 96 may have an upper boundary 98 and a lower boundary 100, and the upper boundary may be united to the support beam. An adjustment slot 102 may be formed in the support plate 96 for passing a portion of the rod 74 through the plate. The adjustment slot may extend into the support plate from the lower boundary 100 and may extend upwardly from the lower boundary. The slot 102 may be open at the lower boundary 100. A portion of the movement rod 74 may pass through the adjustment slot 102, and may be positioned along the slot at virtually an infinite variety of positions to conform to the spatial configuration of the elements of the closure assembly and the bin elevation structure. Additionally, a pair of fastening slots 104, 106 may be formed in the support plate 96 and the fastening slots may be positioned on opposite sides of the adjustment slot, and the slots may be oriented substantially parallel to the adjustment slot.

The support structure 80 may also include a support slide 110 mounted on the support plate which may be movable between different positions on the support plate, and between different positions along the adjustment slot. The support plate 110 may have a support aperture 112 formed therein, and the aperture 112 may be alignable with a portion of the adjustment slot 102. The support slide 110 may be mounted over a portion of the adjustment slot 102, and a portion of the movement rod 74 may pass through the support aperture 112 and through the adjustment slot 102, such as a portion of the first extent 76 of the rod 74. The movement rod 74 is slidable through the support aperture 112 to permit movement of the gate 62 by the rod 74 between the closed and open positions.

The position of the support slide 110 over the adjustment slot may be adjustable to adjust a position of the support aperture 112 on the support plate. Slide mounting fasteners 114 may be provided for mounting the support slide 110 to the support plate 96, and the mounting fasteners 114 may pass through apertures 116 in the support slide 110 and the auxiliary slots 104, 106 in the support plate. The adjustability of the position of the support slide 110 on the support plate 96 permits adjustment of the distance between the support aperture 112 on the slide 110 and the support beam 82 to accommodate bin designs with different distances between the elevation of the gate 62 of the closure assembly and the portion of the bin elevating structure on which the actuation assembly is mounted, such as the cross braces 46, 48, thereby enhancing the adaptability of the actuation assembly to various bin designs.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A system comprising:

a closure actuation assembly configured to actuate a bin closure apparatus on a storage bin apparatus, the bin closure apparatus including a closure assembly movable between a closed condition and an open condition, the closure actuation assembly comprising:

a gate movement structure configured to move a gate of the closure assembly such that movement of the gate movement structure causes movement of the gate, the gate movement structure including a movement rod for being engaged with the gate of the closure assembly, the rod having a first extent for extending from the gate;

a support structure for supporting the gate movement structure on a bin elevating structure of the storage bin apparatus, the support structure comprising:

a support beam for mounting on the bin elevating structure, the support beam being elongated with a pair of opposite end portions;

a securing element provided on the support beam for securing a portion of the support beam to the bin elevating structure;

a support plate mounted on the support beam such that the support beam supports the support plate when the support beam is mounted on the bin elevating structure and the support plate depends from the support beam, the support plate extending along a portion of the length of the support beam between the pair of opposite end portions, the support plate having an upper boundary and a lower boundary opposite of the upper boundary, the upper boundary being united to the support beam, an adjustment slot being formed in the support plate for passing a portion of the movement rod therethrough, the adjustment slot extending into the support plate from the lower boundary toward the upper boundary; and a support slide mounted on the support plate, a support aperture formed in the support slide for receiving a portion of the movement rod passing through the support aperture, the support slide being mounted over a portion of the adjustment slot, a position of the support slide over the adjustment slot being adjustable to adjust a position of the support aperture on the support plate.

2. The system of claim 1 wherein the movement rod has a second extent extending from the first extent, the second extent being oriented substantially perpendicular to the first extent.

3. The system of claim 1 wherein the support structure includes a pair of the securing elements, each of the securing elements being provided for securing one of the end portions of the support beam to a portion of the bin elevating structure.

4. The system of claim 3 wherein the securing elements includes a securing plate and a pair of securing fasteners, the pair of securing fasteners fastening the securing plate to the support beam, the securing fasteners being spaced for positioning the portion of a portion of the bin elevating structure therebetween.

5. The system of claim 1 wherein slide mounting fasteners mount the support slide to the support plate in a manner permitting adjustment of the position of the support slide over the adjustment slot.

6. The system of claim 5 wherein the support plate of the support structure has a pair of fastening slots formed therein, the auxiliary slots being positioned on opposite sides of the adjustment slot, the slide mounting fasteners passing through the support slide and the fastening slots.

7. The system of claim 1 wherein the gate movement structure additionally comprises a rod extension mounted on the movement rod to extend from the first extent of the movement rod toward a gate of the closure assembly.

8. The system of claim 1 additionally comprising a bin closure apparatus for selectively closing a bottom opening of a bin structure of the storage bin apparatus, the bin closure apparatus including the closure assembly configured to selectively close the bottom opening of the bin structure, the closure assembly having a closed condition and an open condition, the closed condition being characterized by the closure assembly being positionable to block movement of contents of the interior of the bin structure from moving out of the bottom opening, the open condition being characterized by the closure assembly not being positionable to block movement of the contents of the interior of the bin structure out of the bottom opening; and wherein the gate movement structure of the closure actuation assembly engages the closure assembly in a manner to move the closure assembly between the closed and opened conditions.

9. The system of claim 8 wherein the closure assembly of the bin closure apparatus includes:

a guide frame for mounting on a bin structure of the storage bin apparatus adjacent to the bottom opening of the bin structure, the guide frame forming a movement track; and a gate mounted on the guide frame and being moveable on the movement track between a closed position on the movement track corresponding to the closed condition of the closure assembly and an open position on the movement track corresponding to the open condition of the closure assembly;

wherein the movement rod of the gate movement structure is connected to the gate to move the gate between the closed and open positions.

10. The system of claim 9 wherein the gate includes a gate tab, the first extent of the movement rod being connected to the gate tab.

11. The system of claim 10 wherein the guide frame of the closure assembly is elongated with a first end and a second end, the guide frame having a guide tab with a guide aperture formed therein, a portion of the movement rod of the gate movement structure extending through the guide aperture in the guide tab to guide movement of the movement rod.

12. The system of claim 1 additionally comprising a storage bin apparatus for storing particulate material, the storage bin apparatus comprising:

a bin structure defining an interior for receiving and holding particulate material, the bin structure having a bottom with a bottom opening in communication with the interior of the bin structure; and a bin elevating structure for elevating the bin structure above a ground surface, the bin elevating structure comprising:

a plurality of legs extending downwardly from the bin structure for resting upon the ground surface; and at least one cross brace extending between one of the legs and the bin structure;

wherein the support beam of the support structure is secured to the at least one cross brace by the securing element of the support structure.

13. The system of claim 12 wherein the at least one cross brace of the bin elevating structure includes a plurality of cross braces, each cross brace of the plurality of cross braces being mounted on one of the legs and the bin structure; and wherein the support beam is mounted on to cross braces of the plurality of cross braces, a said securing element securing each and portion to one of the cross braces of the bin elevating structure.

14. A system comprising:

a bin closure apparatus for selectively closing a bottom opening of a bin structure of a storage bin apparatus, the bin closure apparatus including a closure assembly configured to selectively close the bottom opening of the bin structure, the closure assembly having a closed condition and an open condition, the closed condition being characterized by the closure assembly being positionable to block movement of contents of an interior of the bin structure from moving out of the bottom opening, the open condition being characterized by the closure assembly not being positionable to block movement of the contents of the interior of the bin structure out of the bottom opening, the closure assembly comprising:

a guide frame for mounting on the bin structure adjacent to the bottom opening of the bin structure, the guide frame forming a movement track; and a gate mounted on the guide frame and being moveable on the movement track between a closed position on the movement track corresponding to the closed condition of the closure assembly and an open position on the movement track corresponding to the open condition of the closure assembly; and a closure actuation assembly configured to actuate the closure assembly, the closure actuation assembly comprising:

a gate movement structure for moving the gate of the closure assembly, the gate movement structure including a movement rod connected to the gate of the closure assembly;

a support structure for supporting the gate movement structure on a bin elevating structure of the storage bin apparatus, the support structure comprising:

a support beam for mounting on the bin elevating structure, the support beam being elongated with a pair of opposite end portions;

a securing element provided on the support beam for securing a portion of the support beam to the bin elevating structure;

a support plate mounted on the support beam such that the support beam supports the support plate when the support beam is mounted on the bin elevating structure and the support plate depends from the support beam, the support plate extending along a portion of the length of the support beam between the pair of opposite end portions, the support plate having an upper boundary and a lower boundary opposite of the upper boundary, the upper boundary being united to the support beam, an adjustment slot being formed in the support plate and extending into the support plate from the lower boundary toward the upper boundary, a portion of the movement rod extending through the adjustment slot; and a support slide mounted on the support plate, a support aperture being formed in the support slide, the support slide being mounted over a portion of the adjustment slot to receive the portion of the movement rod passing through the adjustment slot, a position of the support slide over the adjustment slot being adjustable to adjust a position of the support aperture on the support plate and thereby adjust a position of the portion of the movement rod passing through the adjustment slot.

* * * * *